US010961006B2

(12) United States Patent
Young

(10) Patent No.: US 10,961,006 B2
(45) Date of Patent: Mar. 30, 2021

(54) FILM WRAP DISPENSING DEVICE

(71) Applicant: Clinton Young, Livonia, MI (US)

(72) Inventor: Clinton Young, Livonia, MI (US)

( * ) Notice: Subject to any disclaimer, the term of this patent is extended or adjusted under 35 U.S.C. 154(b) by 198 days.

(21) Appl. No.: 16/249,666

(22) Filed: Jan. 16, 2019

(65) Prior Publication Data

US 2020/0223577 A1 Jul. 16, 2020

(51) Int. Cl.
*B65B 67/08* (2006.01)
*B65H 75/08* (2006.01)

(52) U.S. Cl.
CPC ..... *B65B 67/085* (2013.01); *B65H 75/08* (2013.01); *B65H 2402/412* (2013.01)

(58) Field of Classification Search
CPC ..... B65H 75/08; B65H 2402/412; B65H 16/005; B65B 67/085
See application file for complete search history.

(56) References Cited

U.S. PATENT DOCUMENTS 4,102,513 A * 7/1978 Guard ..... B65B 67/085 156/577
4,166,589 A * 9/1979 Hoover ..... B65B 67/085 156/577
4,369,614 A * 1/1983 Tetzner ..... B65B 67/085 242/557
4,714,211 A * 12/1987 Hwang ..... B65B 67/085 242/423.1
D382,429 S 8/1997 Goldstein
5,779,179 A * 7/1998 Zentmyer ..... B65B 67/085 242/423.2
7,237,745 B2 * 7/2007 Martinez ..... B65H 16/06 242/588.2
7,350,741 B1 * 4/2008 Rosa ..... B65H 75/265 242/403
7,357,349 B1 * 4/2008 Huang ..... B65B 67/085 242/405.3
7,543,426 B1 * 6/2009 Phero ..... B65B 67/085 156/574
9,598,196 B2 3/2017 Choi
10,023,342 B1 * 7/2018 Malin ..... B65H 35/002
2004/0046083 A1 * 3/2004 Mazzarolo ..... B65H 16/02 242/578
2007/0262191 A1 * 11/2007 Amron ..... A47K 10/3836 242/597.7
2009/0044494 A1 2/2009 Northrup
2012/0042615 A1 * 2/2012 Roche ..... B65B 67/08 53/461
2012/0153063 A1 6/2012 Furuichi
2014/0116004 A1 * 5/2014 Pace ..... B65H 75/406 53/390

(Continued)

*Primary Examiner* — William A. Rivera

(57) ABSTRACT

A film wrap dispensing device for ergonomically wrapping articles includes a base, a first tube, and a handgrip assembly. The first tube is coupled to and extends perpendicularly from the base and is configured to be inserted into a tubular core of a roll of film wrap. The handgrip assembly is selectively couplable to an upper end of the first tube and is configured to retain the roll of film wrap on the first tube. The handgrip assembly also is configured to be grasped in hands of a user, positioning the user to move the base and the first tube around an object so that the roll of film wrap rotates around the first tube while dispensing film from the roll onto the object.

11 Claims, 5 Drawing Sheets

(56) References Cited

U.S. PATENT DOCUMENTS

| | | | | |
|---|---|---|---|---|
| 2015/0203232 | A1* | 7/2015 | Nelson | B65B 11/006 242/422.4 |
| 2016/0340070 | A1 | 11/2016 | Yu Chen | |
| 2016/0355293 | A1 | 12/2016 | Clarke | |
| 2017/0305583 | A1* | 10/2017 | Nelson | B65B 67/085 |
| 2018/0065827 | A1* | 3/2018 | Nelson | B65B 67/085 |

* cited by examiner

FILM WRAP DISPENSING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispensing devices and more particularly pertains to a new dispensing device for ergonomically wrapping articles.

BRIEF SUMMARY OF THE INVENTION

An embodiment of the disclosure meets the needs presented above by generally comprising a base, a first tube, and a handgrip assembly. The first tube is coupled to and extends perpendicularly from the base and is configured to be inserted into a tubular core of a roll of film wrap. The handgrip assembly is selectively couplable to an upper end of the first tube and is configured to retain the roll of film wrap on the first tube. The handgrip assembly also is configured to be grasped in hands of a user, positioning the user to move the base and the first tube around an object so that the roll of film wrap rotates around the first tube while dispensing film from the roll onto the object.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
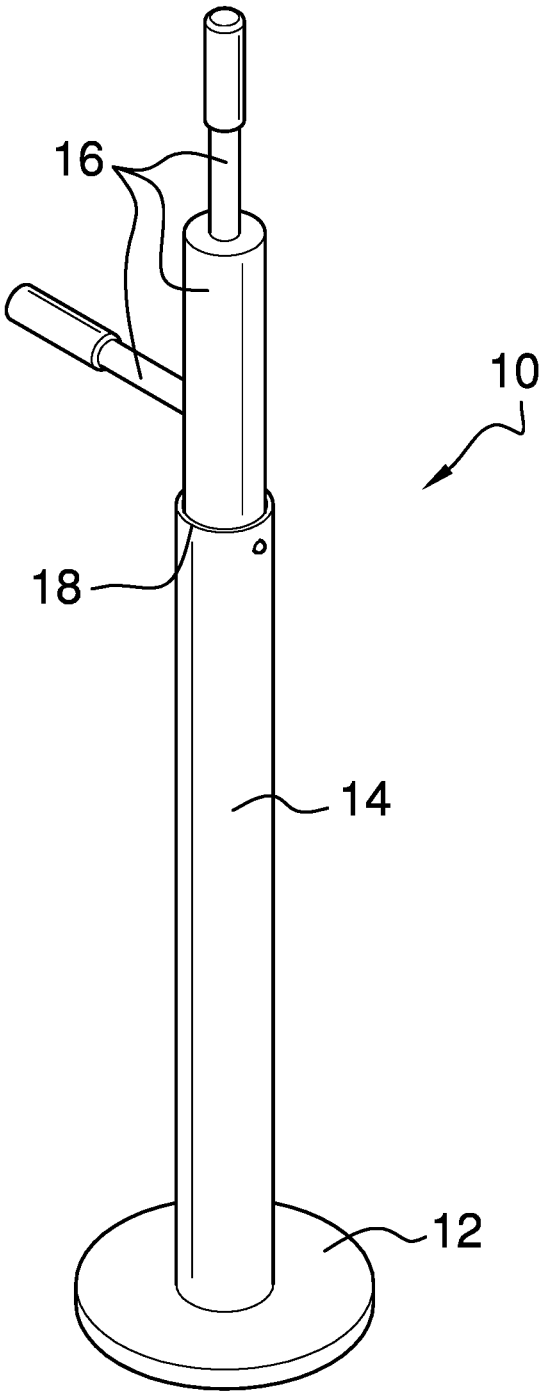
FIG. 1 is an isometric perspective view of a film wrap dispensing device according to an embodiment of the disclosure.
Figure 2:
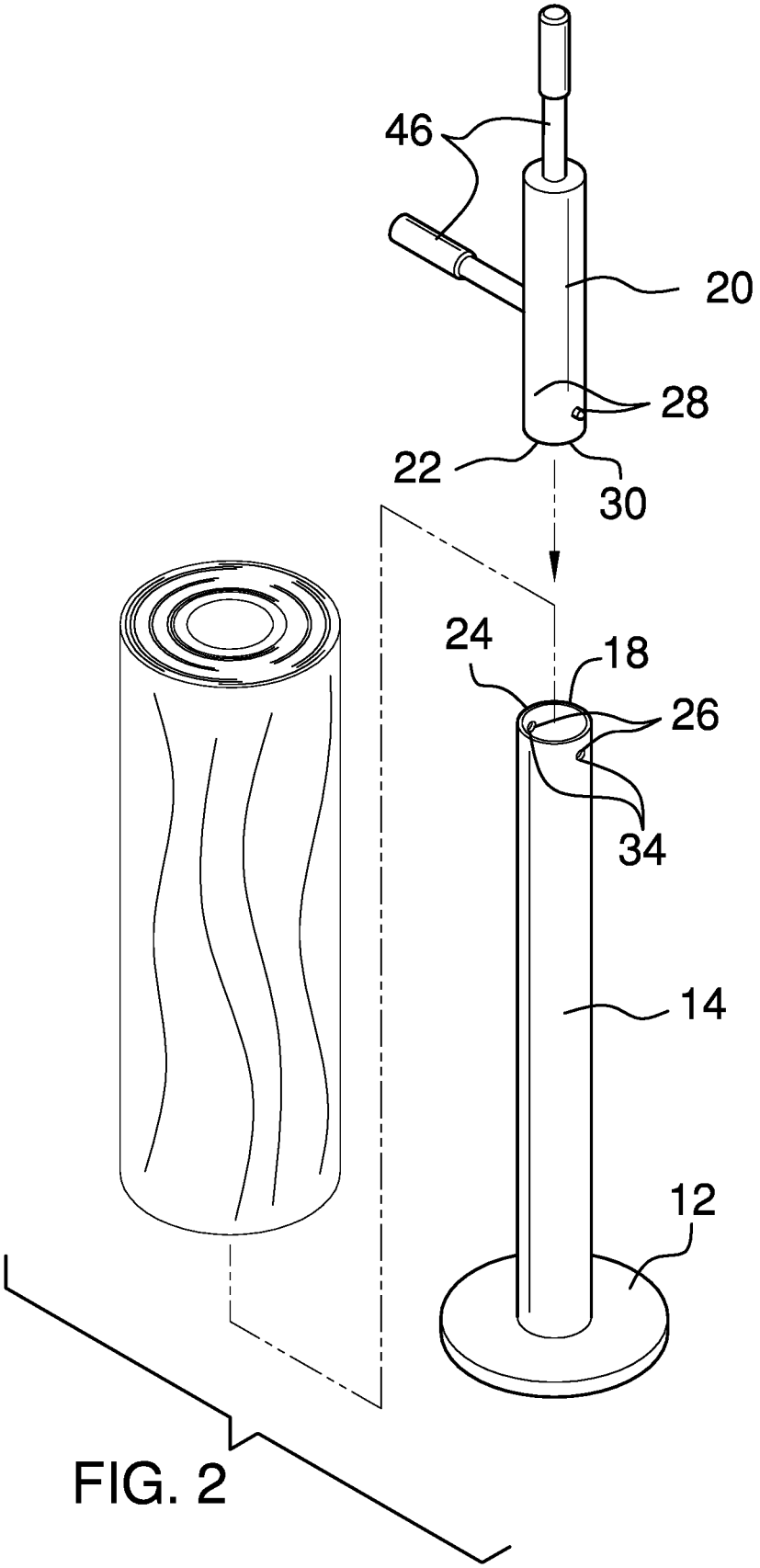
FIG. 2 is an exploded view of an embodiment of the disclosure.

With reference now to the drawings, and in particular to FIGS. 1 through 6 thereof, a new dispensing device embodying the principles and concepts of an embodiment of the disclosure and generally designated by the reference numeral 10 will be described.

As best illustrated in FIGS. 1 through 6, the film wrap dispensing device 10 generally comprises a base 12, a first tube 14, and a handgrip assembly 16. The first tube 14 is coupled to and extends perpendicularly from the base 12 and is configured to be inserted into a tubular core of a roll of film wrap.

The handgrip assembly 16 is selectively couplable to an upper end 18 of the first tube 14 and is configured to retain the roll of film wrap on the first tube 14. The handgrip assembly 16 also is configured to be grasped in hands of a user, positioning the user to move the base 12 and the first tube 14 around an object so that the roll of film wrap rotates around the first tube 14 while dispensing film from the roll onto the object. The present invention is particularly useful in wrapping palleted goods as the user is only required to bend over once to attach an end of the film wrap to the goods.

The first tube 14 is centrally positioned on the base 12, and the base 12 is circularly shaped. This allows the user to grasp the handgrip assembly 16 to tilt the base 12 relative to a surface, enabling the user to roll the base 12 along the surface to move the base 12 and the first tube 14 around the object. The base 12 is coated with at least one of rubber and silicone, allowing the base 12 to roll smoothly and quietly across the surface.

The handgrip assembly 16 comprises a second tube 20 that has an outer circumference 22 which is substantially complementary to an inner perimeter 24 of the first tube 14 so that the second tube 20 is insertable into the first tube 14. A first coupler 26 is coupled to the first tube 14 proximate to the upper end 18. A second coupler 28 is coupled to the second tube 20 proximate to a bottom end 30 of the second tube 20. The second coupler 28 is complementary to the first coupler 26. The second coupler 28 is positioned to selectively couple to the first coupler 26 to removably couple the second tube 20 to the first tube 14 so that the second tube 20 extends linearly from the first tube 14.

The second coupler 28 comprises a plurality of detent pins 32. The first coupler 26 comprises a plurality of holes 34. Each hole 34 is positioned to selectively insert a respective detent pin 32 to removably couple the second tube 20 to the first tube 14. The plurality of detent pins 32 comprises two detent pins 32 that are opposingly positioned on the second tube 20.

Figure 5:
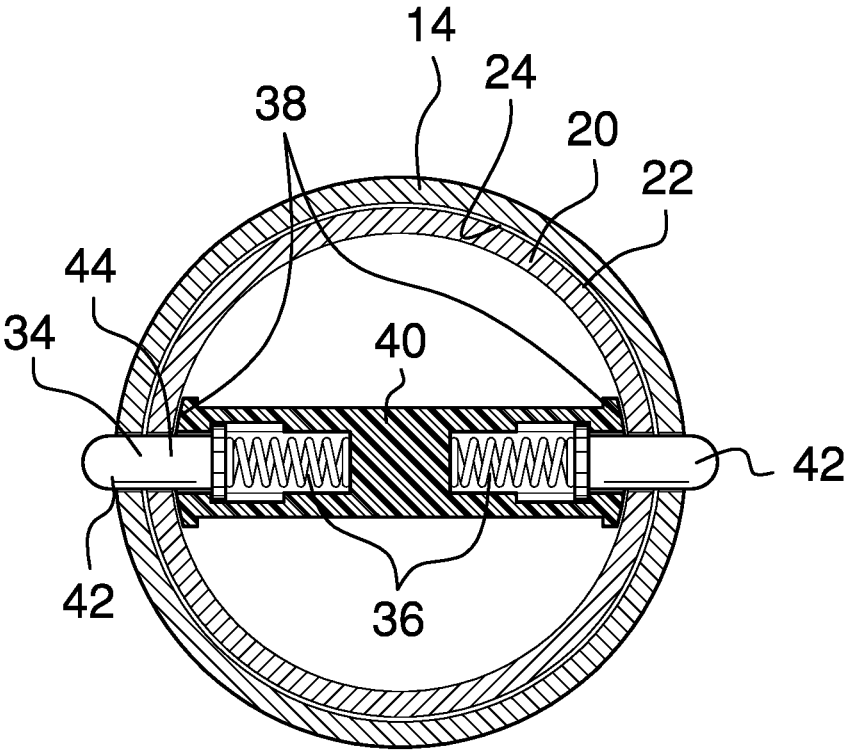
FIG. 5 is a cross-sectional view of an embodiment of the disclosure.

As shown in FIG. 5, the detent pins 32 are positioned singly in a pair of channels 36. Each channel 36 extends into a respective opposing terminus 38 of a bar 40 that is positioned in the second tube 20. A shaft 42 of each detent pin 32 extends from the channel 36 through an associated opening 44 that is positioned in the second tube 20, positioning the shaft 42 to insert into a respective hole 34 that is positioned in the first tube 14 to removably couple the second tube 20 to the first tube 14. To decouple the handgrip assembly 16 from the first tube 14, the user simply depresses each shaft 42 into its associated channel 36.

A pair of handles 46 is coupled to and extends from the second tube 20. Each handle 46 is configured to be grasped in a respective hand of the user, positioning the user to move the base 12 and the first tube 14 around the object so that the roll of film wrap rotates around the first tube 14 while dispensing the film from the roll onto the object.

Figure 3:
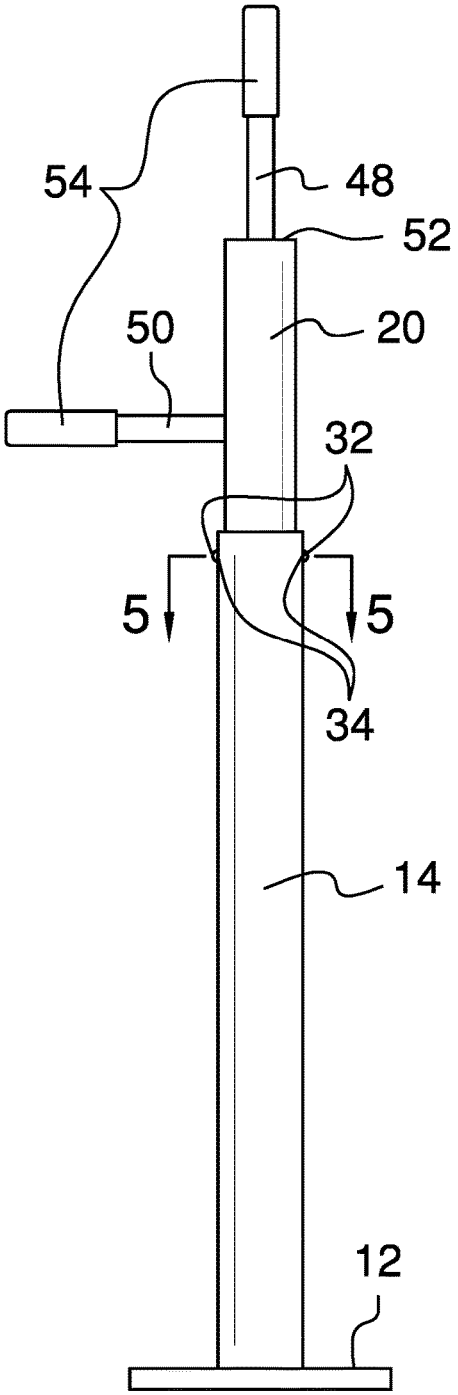
FIG. 3 is a front view of an embodiment of the disclosure.
Figure 4:
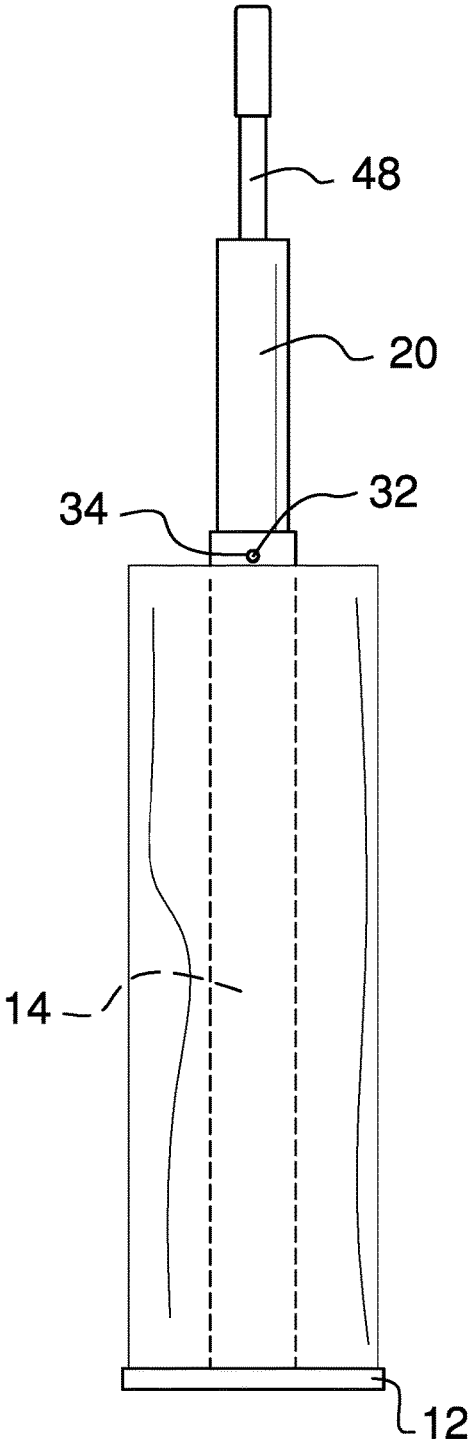
FIG. 4 is a side view of an embodiment of the disclosure.

The pair of handles 46 comprises a first rod 48 and a second rod 50, as shown in FIG. 3. The first rod 48 extends linearly from a top end 52 of the second tube 20. The second rod 50 extends perpendicularly from the second tube 20 substantially equally distant from the top end 52 and the bottom end 30 of the second tube 20. A pair of grips 54 is coupled singly to the first rod 48 and the second rod 50. The grips 54 comprises at least one of rubber and silicone and are configured to enhance grasps of the hands of the user on the first rod 48 and the second rod 50.

Figure 6:
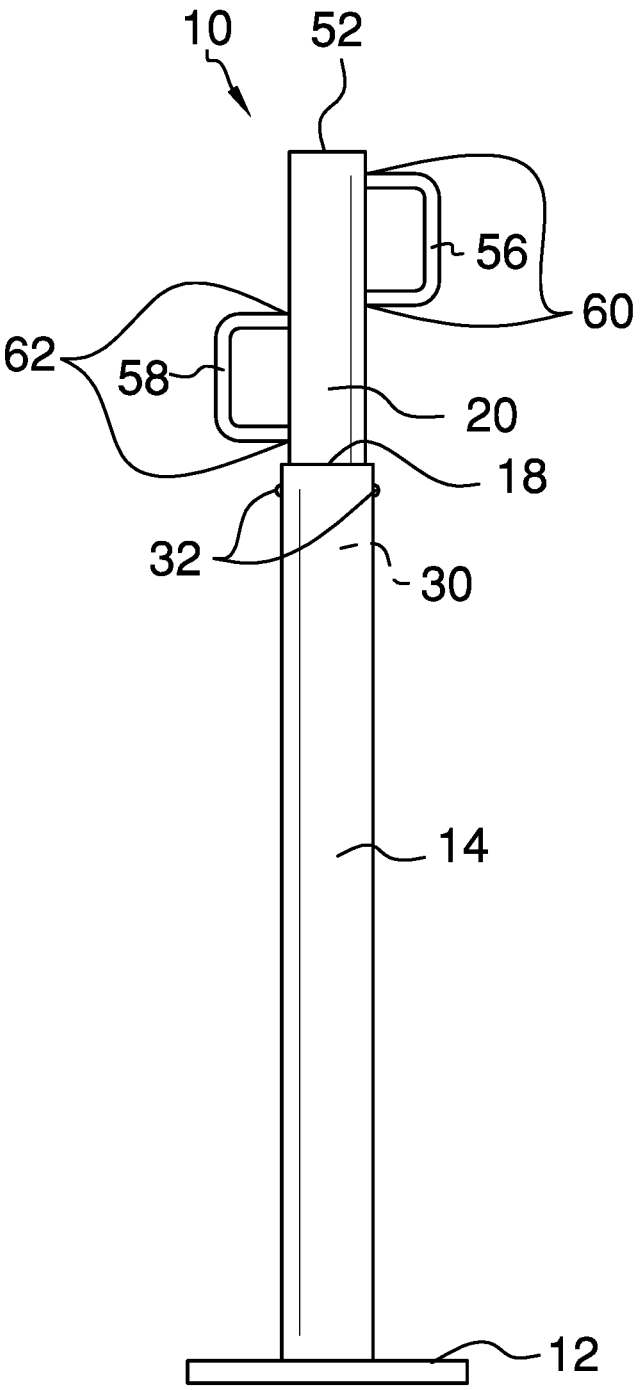
FIG. 6 is a front view of an embodiment of the disclosure.

In another embodiment, as shown in FIG. 6, the pair of handles 46 comprises a first bar 56 and a second bar 58, which are both C-shaped. The first bar 56 has opposing endpoints 60 that are coupled to the second tube 20 so that the first bar 56 extends perpendicularly from the second tube 20 proximate to the top end 52. The second bar 58 has opposing ends 62 that are coupled to the second tube 20 so that the second bar 58 extends perpendicularly from the second tube 20 substantially equally distant from the top end 52 and the bottom end 30 of the second tube 20. The second bar 58 is opposingly positioned on the second tube 20 relative to the first bar 56. The first bar 56 and the second bar 58 are configured to be grasped in the hands of the user, positioning the user to move the base 12 and the first tube 14 around the object so that the roll of film wrap rotates around the first tube 14 while dispensing the film from the roll onto the object.

In use, the first tube 14 is inserted into the tubular core of the roll of film wrap and the handgrip assembly 16 then is coupled to the upper end 18 of the first tube 14 to retain the roll of film wrap on the first tube 14. The handgrip assembly 16 then is grasped in the hands of the user, positioning the user to roll the base 12 and the first tube 14 around the object so that the roll of film wrap rotates around the first tube 14 while dispensing the film from the roll onto the object.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A film wrap dispensing device comprising:

a base;

a first tube coupled to and extending perpendicularly from the base wherein the first tube is configured for inserting into a tubular core of a roll of film wrap, the upper end of the first tube being open; and a handgrip assembly selectively couplable to an upper end of the first tube wherein the handgrip assembly is configured for retaining the roll of film wrap on the first tube and for grasping in hands of a user positioning the user for moving the base and the first tube around an object such that the roll of film wrap rotates around the first tube dispensing film from the roll onto the object, the handgrip assembly comprising a second tube having an outer circumference substantially complementary to an inner perimeter of the first tube such that the second tube is insertable into the first tube, a first coupler coupled to the first tube proximate to the upper end, a second coupler coupled to the second tube proximate to a bottom end of the second tube, the second coupler being complementary to the first coupler wherein the second coupler is positioned for selectively coupling to the first coupler for removably coupling the second tube to the first tube such that the second tube extends linearly from the first tube, the second coupler comprising a plurality of detent pins, the first coupler comprising a plurality of holes wherein each hole is positioned for selectively inserting a respective detent pin for removably coupling the second tube to the first tube, and a pair of handles coupled to and extending from the second tube wherein each handle is configured for grasping in a respective hand of the user positioning the user for moving the base and the first tube around the object such that the roll of film wrap rotates around the first tube dispensing the film from the roll onto the object.

2. The device of claim 1, further comprising:

the base being circularly shaped; and the first tube being centrally positioned on the base.

3. The device of claim 1, further including the base being coated with at least one of rubber and silicone.

4. The device of claim 1, further including the plurality of detent pins comprising two detent pins opposingly positioned on the second tube.

5. The device of claim 4, further including the detent pins being positioned singly in a pair of channels, each channel extending into a respective opposing terminus of a bar positioned in the second tube such that a shaft of each detent pin extends from the channel through an associated opening positioned in the second tube positioning the shaft for inserting into a respective hole positioned in the first tube for removably coupling the second tube to the first tube.

6. The film wrap dispensing device of claim 1, further comprising:

the base being circularly shaped, the base being coated with at least one of rubber and silicone;

the first tube being centrally positioned on the base;

the handgrip assembly comprising the plurality of detent pins comprising two detent pins opposingly positioned on the second tube, the detent pins being positioned singly in a pair of channels, each channel extending into a respective opposing terminus of a bar positioned in the second tube such that a shaft of each detent pin extends from the channel through an associated opening positioned in the second tube positioning the shaft for inserting into a respective hole positioned in the first tube for removably coupling the second tube to the first tube, and the pair of handles comprising a first rod and a second rod, the first rod extending linearly from a top end of the second tube, the second rod extending perpendicularly from the second tube substantially equally distant from the top end and the bottom end of the second tube; and a pair of grips, the grips being coupled singly to the first rod and the second rod wherein the grips are configured for enhancing grasps of the hands on the first rod and the second rod, the grips comprising at least one of rubber and silicone.

7. The device of claim 6, further including the pair of handles comprising a first bar and a second bar, the first bar and the second bar being C-shaped, the first bar having opposing endpoints, the opposing endpoints being coupled to the second tube such that the first bar extends perpendicularly from the second tube proximate to the top end, the second bar having opposing ends, the opposing ends being coupled to the second tube such that the second bar extends perpendicularly from the second tube substantially equally distant from the top end and the bottom end of the second tube, the second bar being opposingly positioned on the second tube relative to the first bar wherein the first bar and the second bar are configured for grasping in the hands of the user positioning the user for moving the base and the first tube around the object such that the roll of film wrap rotates around the first tube dispensing the film from the roll onto the object.

8. A film wrap dispensing device comprising:

a base;

a first tube coupled to and extending perpendicularly from the base wherein the first tube is configured for inserting into a tubular core of a roll of film wrap;

a handgrip assembly selectively couplable to an upper end of the first tube wherein the handgrip assembly is configured for retaining the roll of film wrap on the first tube and for grasping in hands of a user positioning the user for moving the base and the first tube around an object such that the roll of film wrap rotates around the first tube dispensing film from the roll onto the object, the upper end of the first tube being open, the handgrip assembly comprising a second tube having an outer circumference substantially complementary to an inner perimeter of the first tube such that the second tube is insertable into the first tube, a first coupler coupled to the first tube proximate to the upper end, a second coupler coupled to the second tube proximate to a bottom end of the second tube, the second coupler being complementary to the first coupler wherein the second coupler is positioned for selectively coupling to the first coupler for removably coupling the second tube to the first tube such that the second tube extends linearly from the first tube, and a pair of handles coupled to and extending from the second tube wherein each handle is configured for grasping in a respective hand of the user positioning the user for moving the base and the first tube around the object such that the roll of film wrap rotates around the first tube dispensing the film from the roll onto the object, the pair of handles comprising a first rod and a second rod, the first rod extending linearly from a top end of the second tube, the second rod extending perpendicularly from the second tube substantially equally distant from the top end and the bottom end of the second tube.

9. The device of claim 8, further including a pair of grips, the grips being coupled singly to the first rod and the second rod wherein the grips are configured for enhancing grasps of the hands on the first rod and the second rod.

10. The device of claim 9, further including the grips comprising at least one of rubber and silicone.

11. A film wrap dispensing device comprising:

a base;

a first tube coupled to and extending perpendicularly from the base wherein the first tube is configured for inserting into a tubular core of a roll of film wrap;

a handgrip assembly selectively couplable to an upper end of the first tube wherein the handgrip assembly is configured for retaining the roll of film wrap on the first tube and for grasping in hands of a user positioning the user for moving the base and the first tube around an object such that the roll of film wrap rotates around the first tube dispensing film from the roll onto the object, the upper end of the first tube being open, the handgrip assembly comprising a second tube having an outer circumference substantially complementary to an inner perimeter of the first tube such that the second tube is insertable into the first tube, a first coupler coupled to the first tube proximate to the upper end, a second coupler coupled to the second tube proximate to a bottom end of the second tube, the second coupler being complementary to the first coupler wherein the second coupler is positioned for selectively coupling to the first coupler for removably coupling the second tube to the first tube such that the second tube extends linearly from the first tube, and a pair of handles coupled to and extending from the second tube wherein each handle is configured for grasping in a respective hand of the user positioning the user for moving the base and the first tube around the object such that the roll of film wrap rotates around the first tube dispensing the film from the roll onto the object, the pair of handles comprising a first bar and a second bar, the first bar and the second bar being C-shaped, the first bar having opposing endpoints, the opposing endpoints being coupled to the second tube such that the first bar extends perpendicularly from the second tube proximate to the top end, the second bar having opposing ends, the opposing ends being coupled to the second tube such that the second bar extends perpendicularly from the second tube substantially equally distant from the top end and the bottom end of the second tube, the second bar being opposingly positioned on the second tube relative to the first bar wherein the first bar and the second bar are configured for grasping in the hands of the user positioning the user for moving the base and the first tube around the object such that the roll of film wrap rotates around the first tube dispensing the film from the roll onto the object.

* * * * *